US007926736B2

(12) United States Patent
Brenk et al.

(10) Patent No.: US 7,926,736 B2
(45) Date of Patent: Apr. 19, 2011

(54) FUEL INJECTION APPARATUS

(75) Inventors: Achim Brenk, Kaempfelbach (DE); Hans-Christoph Magel, Pfullingen (DE); Volkmar Kern, Paris (FR); Goran Kanis, Calw (DE)

(73) Assignee: Robert Bosch GmbH, Stuttgart (DE)

( * ) Notice: Subject to any disclaimer, the term of this patent is extended or adjusted under 35 U.S.C. 154(b) by 602 days.

(21) Appl. No.: 11/667,119

(22) PCT Filed: Oct. 19, 2005

(86) PCT No.: PCT/EP2005/055350

§ 371 (c)(1),
(2), (4) Date: Jan. 22, 2008

(87) PCT Pub. No.: WO2006/048375

PCT Pub. Date: May 11, 2006

(65) Prior Publication Data

US 2008/0121735 A1 May 29, 2008

(30) Foreign Application Priority Data

Nov. 5, 2004 (DE) ..... 10 2004 053 422

(51) Int. Cl.
*F02M 47/02* (2006.01)

(52) U.S. Cl. ..... 239/90; 239/88; 239/96; 239/127; 123/447

(58) Field of Classification Search ..... 239/88–92, 239/96, 124, 127, 585.1; 251/129.16; 123/446, 123/447, 457

See application file for complete search history.

(56) References Cited

U.S. PATENT DOCUMENTS

| | | | | |
|---|---|---|---|---|
| 7,066,400 | B2 * | 6/2006 | Brenk et al. | 239/124 |
| 7,461,795 | B2 * | 12/2008 | Magel | 239/88 |
| 2002/0145056 | A1 | 10/2002 | Lenk et al. | |
| 2003/0183198 | A1 * | 10/2003 | Mahr et al. | 123/447 |

FOREIGN PATENT DOCUMENTS

| | | | |
|---|---|---|---|
| DE | 102 47 903 | A1 | 4/2004 |
| EP | 1 249 598 | A2 | 10/2002 |

* cited by examiner

*Primary Examiner* — Steven J Ganey
(74) *Attorney, Agent, or Firm* — Ronald E. Greigg

(57) ABSTRACT

An apparatus for injecting fuel into an internal combustion engine having a fuel injector acted on with highly pressurized fuel actuated by means of a metering valve device that is able to control the pressure in a pressure booster control chamber so that in a pressure booster pressure chamber delimited by a pressure booster piston which can be filled via a check valve with high-pressure fuel and communicates with an injection valve member pressure chamber, the pressure booster piston increases the pressure, causing an injection valve member for injecting fuel to open. To assure a correct injection quantity even if an abrupt pressure drop occurs in the high-pressure fuel source, the pressure booster piston is situated and designed so that if a pressure drop occurs in the high-pressure fuel source, then starting from its neutral position, the pressure booster piston has the capacity to execute a pressure compensation movement by means of which the pressure in the pressure booster pressure chamber is adapted to the pressure of the high-pressure fuel source.

16 Claims, 4 Drawing Sheets

FUEL INJECTION APPARATUS

CROSS-REFERENCE TO RELATED APPLICATION

This application is a 35 USC 371 application of PCT/EP 2005/055350 filed on Oct. 19, 2005.

BACKGROUND OF THE INVENTION

1. Field of the Invention

The invention relates to an apparatus for injecting fuel into a combustion chamber of an internal combustion engine, having a fuel injector that can be acted on with highly pressurized fuel by means of a high-pressure fuel source and can be actuated by means of a metering valve device that is able to control the pressure in a pressure booster control chamber so that in a pressure booster pressure chamber delimited by a pressure booster piston, which pressure chamber can be filled via a check valve with fuel from the high-pressure fuel source and communicates with an injection valve member pressure chamber, the pressure booster piston increases the pressure, causing an injection valve member for injecting fuel to open and fuel is injected from the injection valve member pressure chamber into the combustion chamber of the engine.

2. Prior Art

An abrupt pressure drop can occur in the high-pressure fuel source during operation of an internal combustion engine. This can be the case, for example, during a quick transition from full load operation to overrunning operation.

OBJECT AND SUMMARY OF THE INVENTION

The object of the invention is to create an apparatus for injecting fuel into a combustion chamber of an internal combustion engine, having a fuel injector that can be acted on with highly pressurized fuel by means of a high-pressure fuel source and can be actuated by means of a metering valve device that is able to control the pressure in a pressure booster control chamber so that in a pressure booster pressure chamber delimited by a pressure booster piston, which pressure chamber can be filled via a check valve with fuel from the high-pressure fuel source and communicates with an injection valve member pressure chamber, the pressure booster piston increases the pressure, causing an injection valve member for injecting fuel to open and fuel is injected from the injection valve member pressure chamber into the combustion chamber of the engine, which novel apparatus assures a correct injection quantity even if an abrupt pressure drop occurs in the high-pressure fuel source.

In an apparatus for injecting fuel into a combustion chamber of an internal combustion engine, having a fuel injector that can be acted on with highly pressurized fuel by means of a high-pressure fuel source and can be actuated by means of a metering valve device that is able to control the pressure in a pressure booster control chamber so that in a pressure booster pressure chamber delimited by a pressure booster piston, which pressure chamber can be filled via a check valve with fuel from the high-pressure fuel source and communicates with an injection valve member pressure chamber, the pressure booster piston increases the pressure, causing an injection valve member for injecting fuel to open and fuel is injected from the injection valve member pressure chamber into the combustion chamber of the engine, this object is attained in that the pressure booster piston is situated and designed so that if a pressure drop occurs in the high-pressure fuel source, then starting from its neutral position, the pressure booster piston can execute a pressure compensation movement by means of which the pressure in the pressure booster pressure chamber is adapted to the pressure of the high-pressure fuel source. Before the injection, the pressure booster piston exerts pressure on the fuel in the pressure booster pressure chamber by moving inward into the pressure booster pressure chamber, thus reducing the volume of the pressure booster pressure chamber. This movement of the pressure booster piston, which results in the injection of fuel, is referred to as a positive stroke of the pressure booster piston. With its pressure compensation movement, the pressure booster piston executes a movement in the opposite direction so that the volume of the pressure booster pressure chamber is increased. This movement is referred to as a negative stroke of the pressure booster piston. The check valve upstream of the pressure booster pressure chamber prevents the pressure in the pressure booster pressure chamber from dropping when an abrupt pressure drop occurs in the high-pressure fuel source. This can result in the pressure in the pressure booster pressure chamber being temporarily greater than that in the high-pressure fuel source. Since a conventional control unit used to control the fuel injection apparatus only detects the pressure in the high-pressure fuel source and uses this pressure as an input value for determining the triggering duration, this can result in an uncontrolled increase in the injection quantity. The negative stroke of the pressure booster piston assures a rapid adaptation of the pressure level in the pressure booster pressure chamber to the pressure level in the high-pressure fuel source.

A preferred exemplary embodiment of the fuel injection apparatus is characterized in that the pressure booster piston is acted on by a compensation movement return spring device so that when the pressure in the high-pressure fuel source increases again, the pressure booster piston returns to its neutral position counter to the direction of the pressure compensation movement. For example, the compensation movement return spring device is a helical compression spring that is provided in addition to a stroke return spring device that serves to return the pressure booster piston to its neutral position after a positive injection stroke. However, as explained below, the compensation movement of the pressure booster piston can also be produced by means of the stroke return spring device.

Another preferred exemplary embodiment of the fuel injection apparatus is characterized in that the compensation movement return spring device prestresses the pressure booster piston both in and counter to the direction of the pressure compensation movement. This has the advantage that the pressure booster piston requires only one return spring device, which performs two functions, namely producing the return movement after a positive injection stroke and after a negative compensation stroke of the pressure booster piston.

Another preferred exemplary embodiment of the fuel injection apparatus is characterized in that the compensation movement return spring device is clamped between stop rings that are supported in opposite directions on an injector housing. For example, the compensation movement return spring device is a helical compression spring situated concentric to and radially outside the pressure booster piston in a pressure booster working chamber that communicates with the high-pressure fuel source in the neutral state of the injector in which no injection occurs.

Another preferred exemplary embodiment of the fuel injection apparatus is characterized in that one of the stop rings rests against a collar, which is provided on the pressure booster piston and delimits the pressure booster control chamber. Preferably, the end surface of a collar oriented away from the pressure booster control chamber is acted on by the pressure of the high-pressure fuel source.

Another preferred exemplary embodiment of the fuel injection apparatus is characterized in that the stop ring that rests against the collar is able to move back and forth between two stops that are provided on the injector housing. The two stops delimit the negative stroke of the pressure booster piston.

Another preferred exemplary embodiment of the fuel injection apparatus is characterized in that the compensation movement return spring device acts on the end of the pressure booster piston oriented away from the pressure booster pressure chamber and is situated in a pressure booster working chamber that communicates with the high-pressure fuel source. Preferably, the pressure booster working chamber is delimited by an end surface of a collar, which is provided on the pressure booster piston and whose other end surface delimits the pressure booster control chamber.

Another preferred exemplary embodiment of the fuel injection apparatus is characterized in that the compensation return spring device is clamped between a stop affixed to the injector housing and a collar, which is provided on the pressure booster piston and delimits the pressure booster control chamber. Preferably, the end surface of the collar oriented away from the pressure booster control chamber is acted on by the pressure of the high-pressure fuel source.

Another preferred exemplary embodiment of the fuel injection apparatus is characterized in that a pressure relief conduit leads from the pressure booster pressure chamber and communicates with the high-pressure fuel source via the metering valve device; this pressure relief conduit is closed by the pressure booster piston in the neutral state of the fuel injection apparatus and is only opened when a pressure drop occurs in the high-pressure fuel source. The pressure relief conduit can temporarily connect the pressure booster pressure chamber to a control line that communicates with the high-pressure fuel source. Fuel can escape from the pressure booster pressure chamber via this connection. The volumetric flow escaping from the pressure booster pressure chamber permits a quicker adaptation of the pressure level in the pressure booster pressure chamber to the pressure level in the control line. This offers the advantageous possibility of minimizing the negative stroke of the pressure booster piston and the resulting volume increase of the pressure booster pressure chamber. Even with an abrupt pressure drop in the high-pressure fuel source, the pressure level in the pressure booster pressure chamber follows the pressure in the high-pressure fuel source so that the subsequent injection occurs at the correct pressure level.

Other preferred exemplary embodiments of the fuel injection apparatus are characterized in that the metering valve device and/or the injection valve member and/or the pressure booster piston is/are integrated into the fuel injector. This achieves a compact, multifunctional injector.

BRIEF DESCRIPTION OF THE DRAWINGS

Other advantages, features, and details of the invention ensue from the following description in which various exemplary embodiments of the invention are described in detail with reference to the drawings, in which.

DESCRIPTION OF THE PREFERRED EMBODIMENTS

The fuel injection apparatus according to the invention is used to introduce fuel into direct injecting diesel engines. The injection of fuel occurs in a stroke-controlled fashion. This has the advantage that the injection pressure can be adapted to the load and engine speed. Reducing emissions and achieving high specific outputs requires a high injection pressure. Since the achievable pressure level in high-pressure fuel pumps and accumulators (common rails) is limited for strength reasons, a pressure booster integrated into the injector is used to boost the pressure further. In the fuel injection apparatus according to the invention, the pressure booster is triggered with the aid of a pressure booster control chamber, which is also referred to as a differential chamber or differential pressure chamber. The function of the pressure booster will be explained below. The pressure booster permits a flexible multiple injection. For the stable production of very small injection quantities, a needle stroke damper is used, which delays the opening movement of the nozzle needle.

Figure 2:
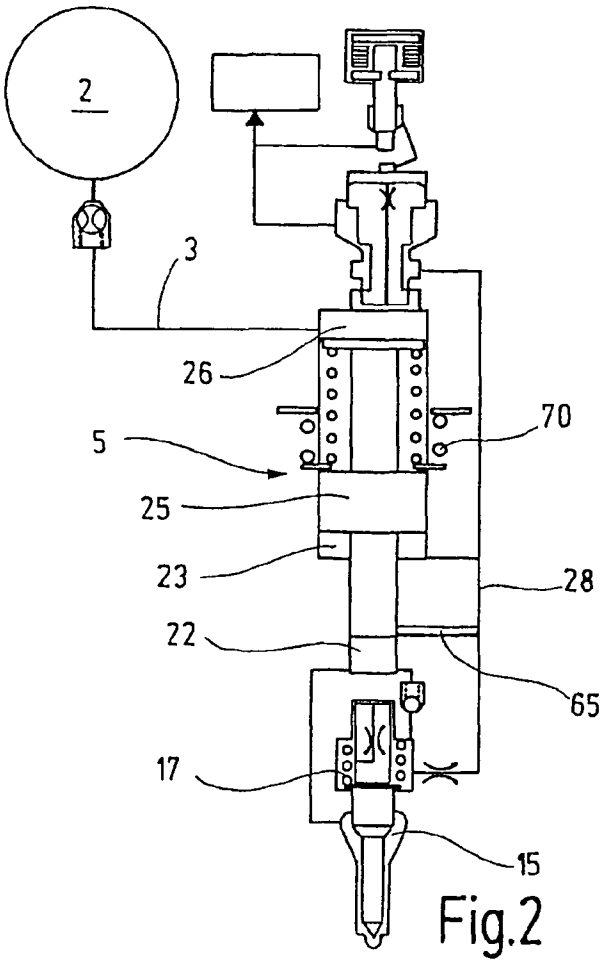
FIG. 2 shows the fuel injection apparatus from FIG. 1 with a reduced rail pressure.
Figure 1:
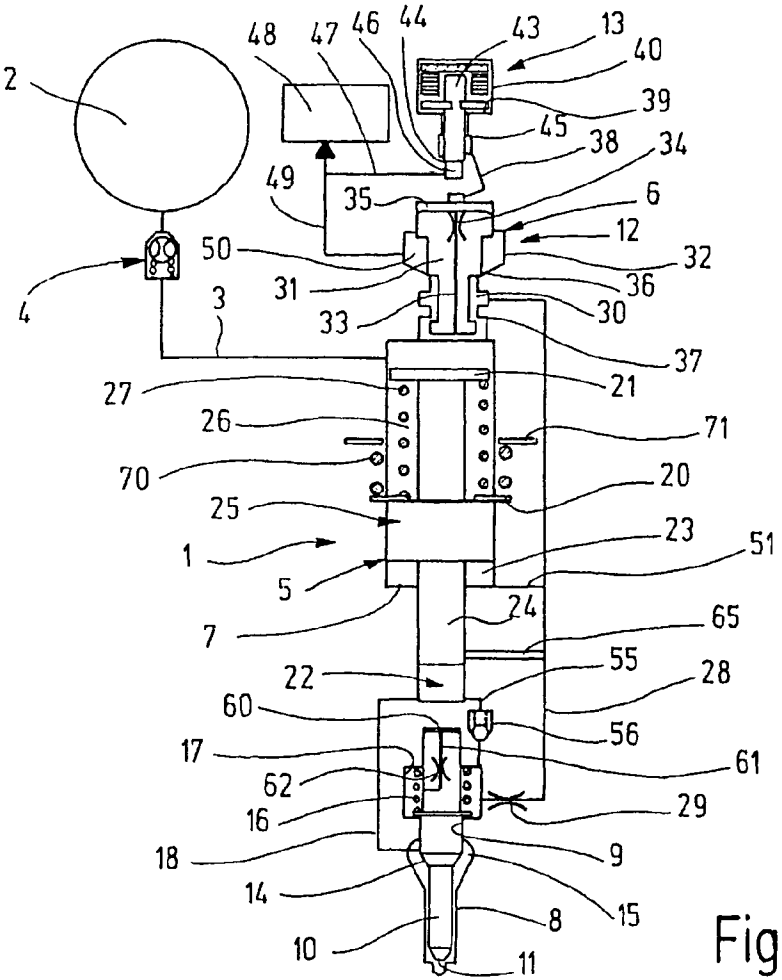
FIG. 1 schematically depicts a first exemplary embodiment of the fuel injection apparatus according to the invention in a longitudinal section through an injector with a constant rail pressure.

FIGS. 1 and 2 represent a longitudinal section through a common rail injector 1 that is supplied with highly pressurized fuel by means of a high-pressure accumulator 2, which is only depicted schematically. The high-pressure accumulator 2 is also referred to as the common rail or as the high-pressure fuel source. From the inside of the high-pressure fuel accumulator 2, a fuel supply line 3, in which a check valve device 4 with an integrated throttle is provided, leads to a pressure booster 5 that is integrated into the fuel injector 1 and is also referred to as a pressure intensifier. The pressure booster 5 is enclosed by an injector housing 6 that is only indicated in FIGS. 1 and 2.

The injector housing 6 contains an injector body 7—of which only the interior is shown in FIGS. 1 and 2—and a nozzle body 8 that has a central guide bore 9. An injection valve member 10, which is also referred to as a nozzle needle, is guided so that it can move back and forth in the guide bore 9. The nozzle needle 10 has a tip 11 on which a sealing surface is embodied, which cooperates with a sealing seat that is embodied on the nozzle body 8. When the tip 11 of the nozzle needle 10 rests with its sealing surface against the sealing seat, this closes the at least one, in particular several, injection openings (not shown) in the nozzle body 8.

When the nozzle needle tip 11 lifts away from its seat, then highly pressurized fuel is injected through the injection openings into the combustion chamber of the engine. The opening movement of the nozzle needle 10 is controlled by means of a metering valve device 12, which is in turn controlled by means of a control valve device 13. The metering valve device 12 is a 3/2-way valve that is integrated into the fuel injector 1. In the exemplary embodiment shown in FIGS. 1 and 2, the control valve device 13 is a spring-loaded, electrically actuatable solenoid valve. In lieu of the solenoid valve, however, it is also possible to use a piezoelectric actuator.

The nozzle needle 10 has a pressure shoulder 14 formed onto it that is situated in a pressure chamber 15 contained in the nozzle body 8, which is also referred to as the injection valve member pressure chamber. A nozzle spring 16 prestresses the nozzle needle 10 with its tip 11 against the associated nozzle needle seat. The nozzle spring 16 is accommodated in a nozzle spring chamber 17 provided inside the injector body 7. The nozzle spring chamber 17 communicates with a pressure booster pressure chamber 22 via a connecting conduit 18.

The pressure booster pressure chamber 22 is comprised of a section of a central bore in the injector body 7 that is embodied in the form of a blind bore. At its end oriented away from the combustion chamber, the bore expands to form a pressure booster control chamber 23. One end 24 of a pressure booster piston 25 is accommodated so that it can move back and forth in the blind bore. The end 24 of the pressure booster piston 25 is embodied in the form of a circular cylinder that has a smaller diameter than the adjoining part of the pressure booster piston 25, which is guided in the expanded section of the blind bore that constitutes the pressure booster control chamber 23. The other end of the pressure booster piston 25 protrudes into a pressure booster working chamber 26 that communicates with the high-pressure fuel accumulator 2 via the fuel supply line 3.

The section of the pressure booster piston 25 with the enlarged outer diameter hydraulically separates the pressure booster working chamber 26 from the pressure booster control chamber 23. The diametrically expanded section of the pressure booster piston 25, which can also be referred to as a collar, rests with its end surface oriented away from the combustion chamber in contact with a circular washer 20 that is fastened to the injector body 7. A pressure booster spring 27 is prestressed between the end surface of the circular washer 20 oriented away from the combustion chamber and a collar 21 situated at the end of the pressure booster piston 25 oriented away from the combustion chamber. The prestressing force of the pressure booster spring 27 prestresses the pressure booster piston 25 in the direction away from the nozzle needle 10.

In the position of the metering valve 12 shown in FIGS. 1 and 2, the pressure booster working chamber 26, which communicates with the high-pressure accumulator 2 via the supply line 3, also communicates with a valve control chamber 30. The valve control chamber 30 in turn communicates with the nozzle spring chamber 17 via a control line 28 in which a throttle device 29 is provided. A valve piston 31 is guided so that it can move back and forth between two positions in the valve control chamber 30. The valve control chamber 30 is contained in a valve body 32 that is part of the injector housing 6.

The valve piston 31 has a central through bore 33 with a throttle restriction 34. The through bore establishes a throttled connection between the pressure booster working chamber 26 and a hydraulic coupling chamber 35 delimited by the end of the valve piston 31 oriented away from the combustion chamber. A first sealing edge 36 and a second sealing edge 37 are embodied in the valve piston 31. In the position of the valve piston 31 shown in FIGS. 1 and 2, the first sealing edge 36 rests against a sealing surface that is provided on the injector housing. In the position of the valve piston 31 shown in FIGS. 1 and 2, the second sealing edge 37 is spaced a certain distance (not visible) apart from a sealing surface that is embodied on the valve body 32 or on the injector housing 6.

The hydraulic coupling chamber 35 communicates via a connecting line 38 with an annular chamber 45 embodied in a control valve body 40. The control valve body 40 is part of the injector housing 6. An actuator 43 of the control valve 13 is accommodated so that it can move back and forth in a control valve chamber 39. The end of the actuator 43 oriented toward the combustion chamber has an actuator head with a sealing edge 44 that rests against an associated sealing surface provided on the control valve body 40.

On the side of the sealing edge 44 oriented away from the combustion chamber, the control valve body 40 contains the annular chamber 45 into which the connecting line 38 feeds. At the end of the actuator 43 oriented toward the combustion chamber, the control valve body 40 contains a pressure relief chamber 46 that communicates with a low-pressure region 48 via a connecting line 47. The contact of the sealing edge 44 against its associated sealing surface interrupts a communication between the annular chamber 45 and the pressure relief chamber 46. When the sealing edge 44 lifts away from its associated sealing seat, this opens a communication between the annular chamber 45 and the pressure relief chamber 46.

A connecting line 49 that leads from a metering valve chamber 50 contained in the valve body 32 also feeds into the low-pressure region 48. The contact of the first sealing edge 36 of the valve piston 31 against its associated sealing seat, which is also referred to as the sealing surface, interrupts a communication between the valve control chamber 30 and the metering valve chamber 50. When the first sealing edge 36 of the valve piston 31 lifts away from its associated sealing seat, this opens the communication between the valve control chamber 30 and the metering valve chamber 50. In this position (not shown) of the valve piston 31, the control line 28 is pressure-relieved into the low-pressure region 48.

The control line 28 communicates with the pressure booster control chamber 23 via a connecting line 51. When the valve piston 31 is moved out of its position shown in FIGS. 1 and 2 in an upward direction, i.e. away from the combustion chamber, then the first sealing edge 36 opens so that a communication is opened between the pressure booster control chamber 23 and the low-pressure region 48 via the connecting line 51, the control line 28, the valve control chamber 30, the metering valve chamber 50, and the connecting line 49. At the same time, the second sealing edge 37 interrupts a connection (that is open in the position shown in FIGS. 1 and 2) between the pressure booster working chamber 26 and the valve control chamber 30. In this position (not shown in FIGS. 1 and 2) of the valve piston 31, the pressure prevailing in the pressure booster working chamber 26 assures that the pressure booster piston 25 is moved downward, i.e. toward the combustion chamber, in order to increase the pressure in the pressure booster pressure chamber 22. Due to the presence of the connecting conduit 18, the increased pressure also prevails in the pressure chamber 15. The increased pressure in the pressure chamber 15 assures that the tip 1 of the nozzle needle 10 is moved upward, i.e. away from the combustion chamber, counter to the prestressing force of the nozzle spring 16 so that an injection of fuel occurs.

In a connecting conduit 55 that leads from the pressure booster pressure chamber 22, a check valve 56 is arranged so that it closes when a higher pressure prevails in the pressure booster pressure chamber 22 than in the nozzle spring chamber 17 into which the connecting conduit 55 feeds. After the injection, the pressure booster pressure chamber 22 is filled with fuel from the nozzle spring chamber 17 via the connecting conduit 55. The nozzle spring chamber 17 in turn communicates with the high-pressure accumulator 2 via the control line 28 with the throttle device 29, the valve control chamber 30, the pressure booster working chamber 26, and the supply line 3.

At the end of the nozzle needle 10 oriented away from the combustion chamber, the nozzle body 8 contains an injection valve member control chamber 60. The injection valve member control chamber 60 is delimited by the end of the nozzle needle 10 oriented away from the combustion chamber and communicates with the nozzle spring chamber 17 via a connecting conduit 61, which is provided in the end of the nozzle needle 10 oriented away from the combustion chamber. The connecting conduit 61 contains a throttle device 62 that opens a larger flow cross section during the filling of the injection valve member control chamber 60 than during the emptying of the injection valve member control chamber 60. This enables a slow opening and a rapid closing of the nozzle needle 10.

The common rail injector 1 with the integrated pressure booster 5 shown in FIGS. 1 and 2 is controlled by means of the metering valve 12, which is embodied in the form of a 3/2-way valve. The check valve 56 separates the pressure booster pressure chamber 22 from the nozzle spring chamber 17. After each injection, the pressure booster pressure chamber 22 is refilled with rail pressure via the check valve 56. As soon as an injection occurs and the pressure booster 5 is activated, the pressure in the pressure booster pressure chamber 22 increases and the check valve 56 closes due to the pressure difference between the rising pressure in the pressure booster pressure chamber 22 and the falling pressure in the control line 28.

During the operation of the internal combustion engine, in particular during operation of a motor vehicle equipped with the engine, situations can occur in which the rail pressure drops in a highly dynamic fashion. Since the check valve 56 is now closed because of the pressure difference between the pressure booster pressure chamber 22 and the control line 28, the pressure in the pressure booster pressure chamber 22 is greater than the rail pressure. Via guides on the nozzle needle 10 and the pressure booster piston 25, which is also referred to as the pressure intensifier piston, the pressure in the pressure booster pressure chamber 22 decreases more slowly than in the high-pressure accumulator 2, which is also referred to as the rail. Since as a rule, a control unit of the fuel injection apparatus is only able to detect the rail pressure and uses this as an input value for the determination of the triggering duration of the injector 1, in injections that take place during the pressure decrease in the rail, an uncontrollable increase in the injection quantity can occur. The fuel injection apparatus according to the invention makes it possible to reduce the pressure in the pressure booster pressure chamber 22 down to the rail pressure level during the injection pauses.

The pressure relief of the pressure booster pressure chamber 22 achieved according to the invention is implemented by means of a movement of the pressure booster piston 25 in the reverse direction, i.e. oriented away from the combustion chamber. This reverse movement of the pressure booster piston 25 opens a pressure relief conduit 65 that temporarily connects the pressure booster pressure chamber 22 to the control line 28 as shown in FIG. 2 and permits a volumetric flow from the pressure booster pressure chamber 22 into the control line 28. This volumetric flow permits a quicker adaptation of the pressure level in the pressure booster pressure chamber 22 to the pressure level in the control line 28, thus making it possible to minimize the reverse-oriented stroke of the pressure booster piston 25 and the resulting volume increase of the pressure booster pressure chamber 22.

During the injection pauses and with a constant rail pressure, the injector 1 and the rail 2 are at the same pressure level. This state is shown in FIG. 1. If the pressure in the rail 2 decreases, then the check valve 56 closes and the volume of the pressure booster pressure chamber 22 remains at the originally prevailing pressure level. This state is shown in FIG. 2. In the state shown in FIG. 1, the normal, high rail pressure prevails in the high-pressure fuel accumulator 2, the supply line 3, the pressure booster working chamber 26, the valve control chamber 30, the control line 28, the pressure booster control chamber 23, the pressure booster pressure chamber 22, the pressure chamber 15, and the nozzle spring chamber 17.

In the state of the fuel injection apparatus shown in FIG. 2, the originally prevailing high rail pressure prevails only in the pressure booster pressure chamber 22 and the pressure chamber 15. The reduced rail pressure prevails in the high-pressure accumulator 2, the supply line 3, the pressure booster working chamber 26, the control line 28, the pressure booster control chamber 23, the nozzle spring chamber 17, and the associated connecting lines. Because of the compressive forces acting on the pressure booster piston 25 in the state shown in FIG. 2, the pressure booster piston 25 in FIG. 2 moves upward, thus increasing the volume of the pressure booster pressure chamber 22. At the same time as the reverse-oriented movement of the pressure booster piston 25, a connection between the pressure booster pressure chamber 22 of the pressure booster 5 and the metering valve 12 is opened via the pressure relief conduit 65 so that a pressure compensation occurs between these two regions.

Even with an abrupt drop in the rail pressure, it is possible for the pressure level in the pressure booster pressure chamber 22 to follow the rail pressure, thus enabling the subsequent injections to always occur at the correct pressure level. In addition, this assures that when a rail pressure decrease occurs without an injection, an undesired injection does not occur since no elevated pressure level that could open the nozzle needle remains in the high-pressure region. In addition, only a small travel distance has to be provided for the reverse-oriented movement of the pressure booster piston 25 since the compensation of the pressure level does not occur solely by means of the reverse movement and the resulting volume increase. Consequently, in lieu of the helical compression spring 70 of the kind shown in FIGS. 1 and 2, it is also possible, for example, to use a disk spring or a tubular spring to reset the pressure booster piston 25. The helical compression spring 70 is clamped between the circular washer 20 and a stop 71 affixed to the injector housing.

Figure 3:
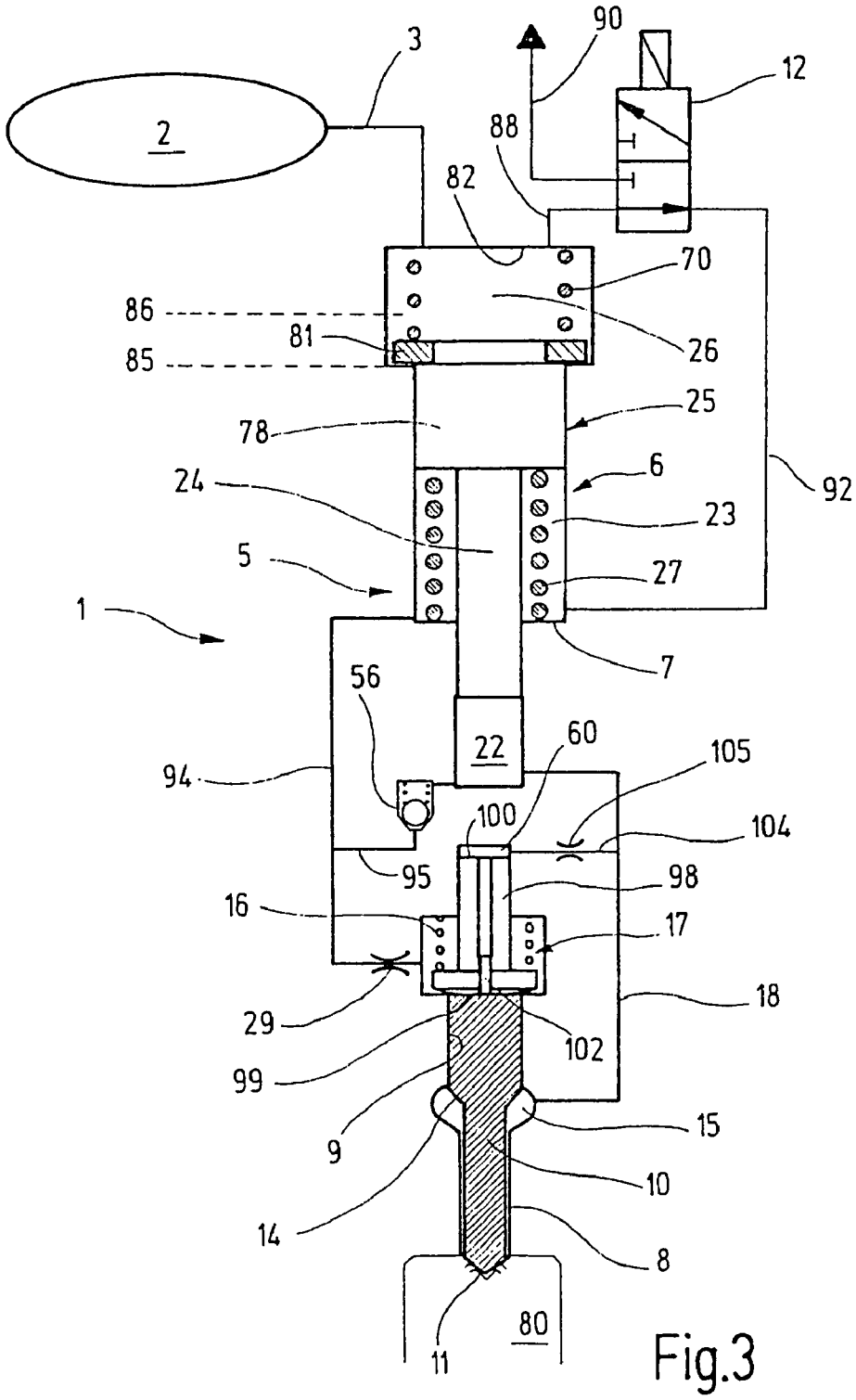
FIG. 3 schematically depicts a second exemplary embodiment of the fuel injection apparatus according to the invention in a longitudinal section through an injector in the normal state.
Figure 4:
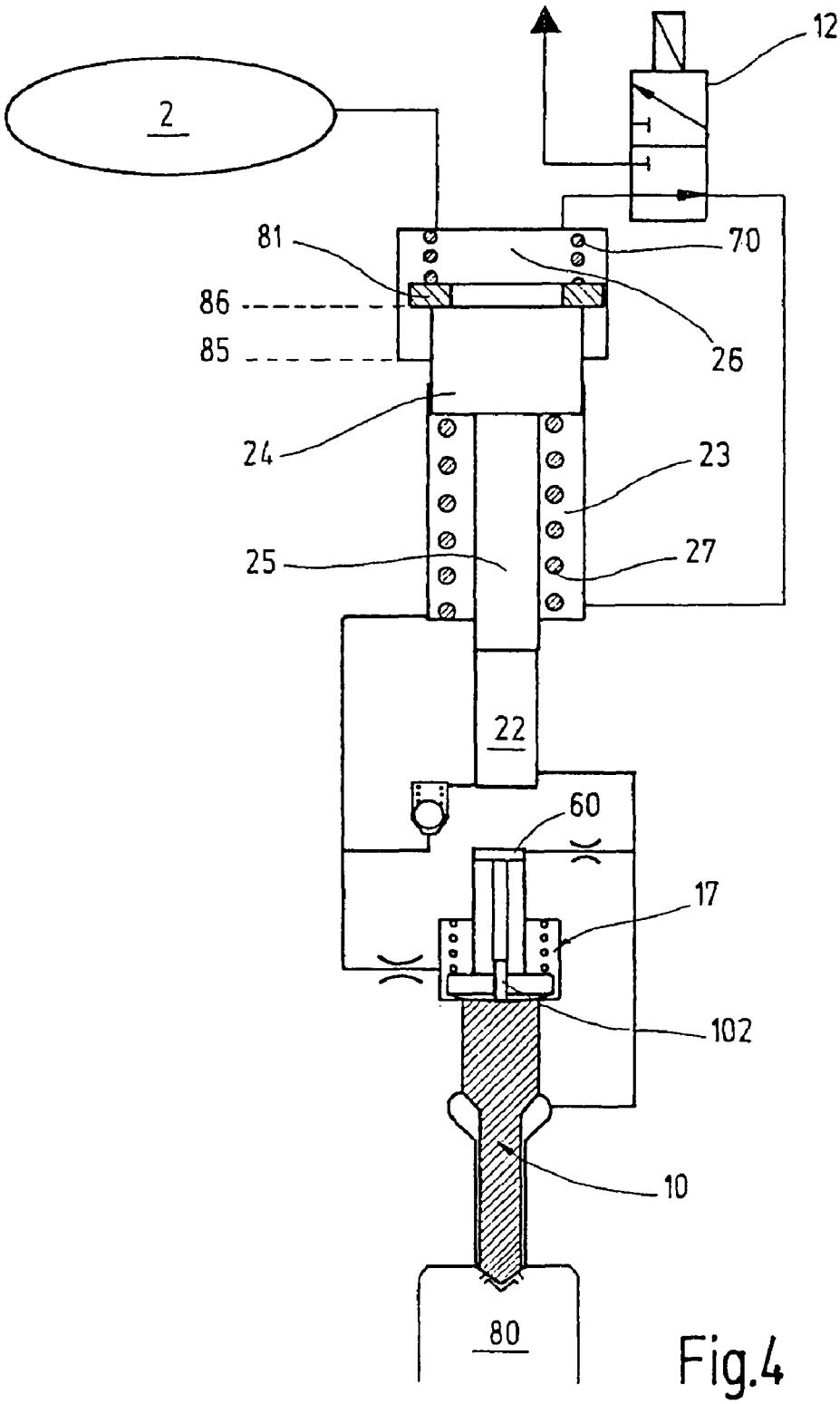
FIG. 4 shows the fuel injection apparatus from FIG. 3 with a reduced rail pressure in the pressure-relieved state.
Figure 5:
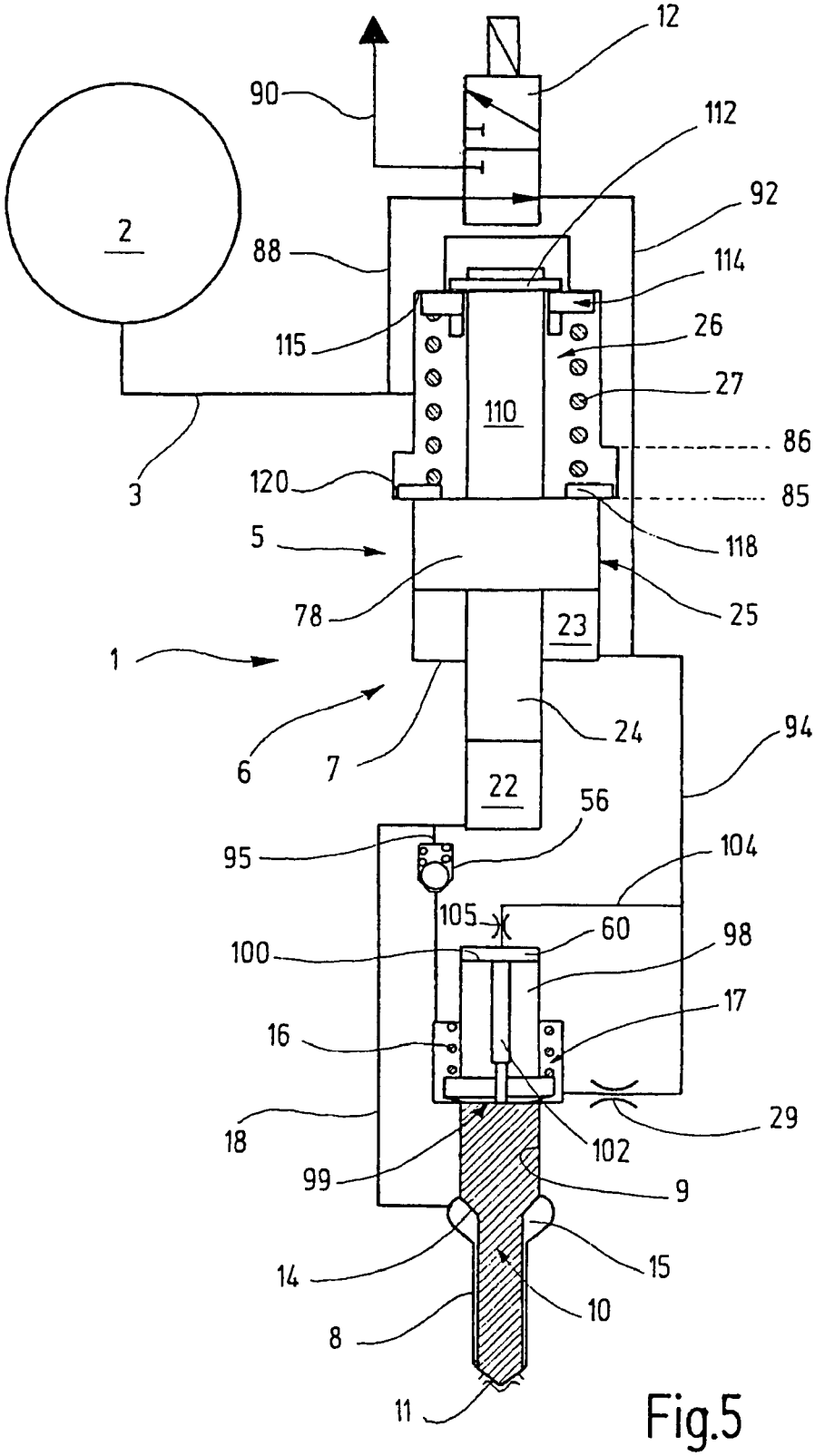
FIG. 5 schematically depicts a third exemplary embodiment of the fuel injection apparatus according to the invention in a longitudinal section through an injector in the normal state.

FIGS. 3 through 5 describe exemplary embodiments similar to the one shown in FIGS. 1 and 2. Parts that are the same have been labeled with the same reference numerals. In order to avoid repetitions, reference is hereby made to the description of FIGS. 1 and 2 given above. The description below will be limited exclusively to the differences between the individual exemplary embodiments as well as the function and advantages of the various fuel injection apparatuses.

The fuel injection apparatus shown in FIGS. 3 and 4 has a pressure booster piston 25 whose end oriented toward the combustion chamber is embodied in the form of a circular cylinder 24. At the end of the circular cylinder 24 oriented away from the combustion chamber, the piston 25 has a collar 78 that is guided so that it can move back and forth inside the injector body 7. The end surface of the collar 78 oriented toward the combustion chamber delimits the pressure booster control chamber 23. The end surface of the collar 78 oriented away from the combustion chamber delimits the pressure booster working chamber 26 that communicates with the high-pressure fuel accumulator 2 via the supply line 3. The combustion chamber into which the highly pressurized fuel is injected from the injector 1 is labeled with the reference numeral 80 in FIGS. 3 and 4.

The end of the collar 78 oriented away from the combustion chamber has a spring stop ring 81 that has a larger outer diameter than the collar 78. The spring stop ring 81 is accommodated in the pressure booster working chamber 26, which has a larger diameter than the pressure booster control chamber 23. The pressure booster control chamber 23 in turn has a larger diameter than the pressure booster pressure chamber 22. In the exemplary embodiment shown in FIG. 3, the return spring device 70 is comprised of a helical compression spring that is clamped between the spring stop ring 81 and an end wall 82 of the pressure booster working chamber 26 oriented away from the combustion chamber. In FIG. 3, the pressure booster piston 25 is in its normal state, as indicated by a dashed line 85. The pressure compensation position of the pressure booster piston 25, i.e. after the rail pressure has been lowered, is depicted by another dashed line 86. In FIG. 4, the pressure booster piston 25 is situated in its pressure compensation position.

In the exemplary embodiment shown in FIGS. 3 through 5, a connecting line 88 leads from the pressure booster working chamber 26 to the metering valve device 12 that is embodied in the form of a magnet-actuated 3/2-way valve. From the metering valve device 12, a connecting line 90 leads to a low-pressure region (not shown in detail). In addition, a control line 92, which can also be referred to as the first control line 92, leads from the valve device 12 to the pressure booster control chamber 23.

In the position of the metering valve 12 shown in FIGS. 3 and 4, the pressure booster working chamber 26 communicates with the pressure booster control chamber 23 via the connecting lines 88 and 92. Another control line 94, which can also be referred to as the second control line 94, connects the pressure booster control chamber 23 to the nozzle spring chamber 17 via the throttle 29. A connecting line 95 that contains the check valve 56 branches off from the second control line 94 and leads to the pressure booster pressure chamber 22.

The nozzle needle 10 cooperates with a damper piston 98 whose end oriented toward the combustion chamber is embodied as cambered and rests against the end of the nozzle needle 10 oriented away from the combustion chamber. The end 100 of the damper piston 98 oriented away from the combustion chamber delimits the injection valve member control chamber 60. The damper piston 98 has a central through bore 102 with a throttle restriction. The injection valve member control chamber 60 communicates with the connecting conduit 18 via a connecting line 104 that contains a throttle 105.

In the neutral state of the fuel injection apparatus, the solenoid valve 12 is closed. The nozzle needle 10 rests with its tip 11 against the associated seat so that no injection occurs. The pressure booster piston 25 is pressure-compensated so that no pressure boosting occurs. The pressure booster piston 25 is situated in its defined intermediate position 85, which is shown in FIG. 3. The pressure of the high-pressure fuel source 2 prevails in all of the chambers of the injector 1. Consequently, an injection based on the rail pressure can take place at any time.

In FIG. 3, the pressure booster piston 25 assumes its defined intermediate position 85, which is also referred to as its starting position, because the spring force of the return spring device 70 is greater than the spring force of the pressure booster spring 27. After a drop in the rail pressure, the pressure decreases in the pressure booster working chamber 26 and the pressure booster control chamber 23. The pressure booster pressure chamber 22 cannot normally be pressure-relieved because all of the connecting paths to the rail pressure are closed and the pressure booster piston 25 is unable to execute any negative stroke in conventional fuel injections. A pressure compensation by means of the guides on the pressure booster piston 25 and nozzle needle 10 can only occur very slowly. According to the present invention, the pressure booster pressure chamber 22 is pressure-relieved due to the fact that the pressure booster piston 25 can retract slightly further from the intermediate position 85 until it reaches its pressure compensation position 86. At the same time, the stop ring 81 is slid upward along with it, i.e. in the direction away from the combustion chamber. With an increase in the rail pressure, the pressure booster piston returns to its defined intermediate position 85 due to the spring forces of the springs 27 and 70.

The exemplary embodiment shown in FIG. 5 is similar to the exemplary embodiments shown in FIGS. 1 through 4. Parts that remain the same have been labeled with the same reference numerals. In order to avoid repetitions, reference is hereby made to the description of FIGS. 1 through 4 given above. The discussion below will concentrate on the differences between the individual exemplary embodiments.

In the exemplary embodiment shown in FIG. 5, the end of the collar 78 of the pressure booster piston 25 oriented away from the combustion chamber has an essentially circular, cylindrical piston section 110 extending from it, whose end oriented away from the combustion chamber has a collar 112. The end surface of the collar 112 oriented toward the combustion chamber is contacted by a stop ring 114, whose end surface oriented away from the combustion chamber in turn rests against a stop 115 of the injector housing 6. The end surface of the collar 78 of the pressure booster piston 25 oriented away from the combustion chamber is contacted by an additional stop ring 118 that rests with its end surface oriented toward the combustion chamber against another stop 120 of the injector housing 6. The pressure booster spring 27, which simultaneously also functions as a return spring device 70 in the exemplary embodiment shown in FIG. 5, is situated between the two stop rings 114, 118.

In the deactivated neutral state of the injector 1, the pressure of the high-pressure accumulator 2 acts on the pressure booster control chamber 23 via the metering valve device 12 and also acts on the pressure booster working chamber 26. The connecting line 90 to the low-pressure region is closed. In the neutral state, the pressure booster piston 25 is pressure-compensated and no pressure boosting occurs. The nozzle needle 10 is closed.

In order to activate the injector 1, the metering device 12 decouples the pressure booster control chamber 23 from the high-pressure fuel source 2 in that from the first position shown in FIG. 5, the metering valve 12 is moved into its second position. In this second position (not shown) of the metering valve 12, the pressure booster control chamber 23 is pressure-relieved into the return 90 via the control line 92. The pressure booster piston 25 begins its injection stroke and moves downward, i.e. toward the combustion chamber. This increases the pressure in the pressure booster pressure chamber 22 in accordance with the boosting ratio of the pressure booster 5 and this increased pressure is conveyed to the injection nozzle. The check valve 56 is closed and seals the pressure booster pressure chamber 22. The nozzle needle begins to open, as a result of which fuel from the injection valve member control chamber 60 must be displaced via the throttle 105. This reduces the needle opening speed.

During the injection, the metering valve 12 separates the pressure booster control chamber 23 from the return 90 and connects it to the supply pressure of the high-pressure fuel accumulator 2. As a result, rail pressure builds up in the pressure booster control chamber 23 and the control line 92. At the same time, the pressure in the pressure booster pressure chamber 22 and the pressure chamber 15 falls to the rail pressure. The nozzle needle 10 closes. The nozzle needle 10 in this case is separated from the damper piston 98 and executes a rapid closing motion. The damper piston 98 is then reset by the hydraulic forces.

After the pressure compensation of the system, the pressure booster spring 27 returns the pressure booster piston 25 to its starting position in the course of which the pressure booster pressure chamber 22 is filled via the check valve 56. The starting position of the pressure booster piston 25 is defined by the contact of the stop ring 114 with the injector housing at 115. The pressure booster piston 25 cannot be retracted any further due to the return spring force of the pressure booster spring 27.

When the pressure booster piston 25 is in its starting position, the check valve 56 seals the high-pressure region off from the control line 94 and the damper module, which includes the damper piston 98, so that no pressure drop can occur in this region. The high-pressure region includes the pressure booster pressure chamber 22, the connecting conduit 18 and the pressure chamber 15 When the system pressure, i.e. the pressure in the high-pressure accumulator 2, is reduced very quickly, then a drop occurs in the pressure on the end of the nozzle needle 10 oriented away from the combustion chamber 10. The high pressure, however, is maintained in the nozzle needle pressure chamber 15. As a result, the nozzle needle 10 opens and an undesired injection occurs until the excess pressure in the high-pressure region has been relieved.

In order to avoid an undesired injection of this kind, the pressure booster piston 25 according to the present invention is embodied so that in the neutral state of the injector 1, when an excess pressure is generated in the pressure booster pressure chamber 22, the pressure booster piston 25 is still able to execute a negative stroke beyond its neutral position. To this end, the stop ring 118 can be moved—in opposition to the prestressing force of the pressure booster spring 27—from its neutral position 85 upward in the axial direction, i.e. away from the combustion chamber, and into its pressure compensation position 86. The stop ring 114 is embodied so that the end 110 of the pressure booster piston 25 oriented away from the combustion chamber can move further upward, i.e. away from the combustion chamber, in the injector housing 6.

When an excess pressure is generated in the pressure booster pressure chamber 22 due to a rapid pressure drop in the injector 1, then the pressure booster piston 25 executes a negative stroke beyond its neutral position 85 and by means of the volume that this opens up, reduces an excess pressure in the pressure booster pressure chamber 22. Only a slight pressure difference occurs, dictated by the pressure surfaces of the pressure booster piston 25 and the spring force. During the normal resetting of the pressure booster piston 25 after an injection stroke, the pressure booster piston 25 is only reset to its neutral position 85, which is defined by the stop 120 of the stop ring 118 on the injector housing since spring force is no longer being exerted on the pressure booster piston 25. Because of the excess pressure in the pressure booster pressure chamber 22, the pressure booster piston 25 is still able to execute an additional negative stroke in relation to the neutral position 85. In this case, the pressure booster spring 27 assumes the function of a return spring that acts in the direction of the neutral position 85 of the pressure booster piston 25 until the pressure compensation position 86 is reached. The pressure booster spring 27 fixes the pressure booster piston 25 in its neutral position 85.

The foregoing relates to a preferred exemplary embodiment of the invention, it being understood that other variants and embodiments thereof are possible within the spirit and scope of the invention, the latter being defined by the appended claims.

The invention claimed is:

1. In a fuel injection apparatus for injecting fuel into a combustion chamber of an internal combustion engine, having a fuel injector that can be acted on with highly pressurized fuel by means of a high-pressure fuel source and can be actuated by means of a metering valve device that is able to control the pressure in a pressure booster control chamber so that in a pressure booster pressure chamber delimited by a pressure booster piston, which pressure chamber can be filled via a check valve with fuel from the high-pressure fuel source and communicates with an injection valve member pressure chamber, the pressure booster piston increases the pressure, causing an injection valve member for injecting fuel to open and fuel is injected from the injection valve member pressure chamber into the combustion chamber of the engine, the improvement wherein, in the event of a pressure drop in the high pressure fuel source, the pressure booster piston is situated and designed so that, starting from its neutral position, the pressure booster piston has the capacity to execute a pressure compensation movement by means of which the pressure in the pressure booster pressure chamber is adapted to the reduced pressure of the high-pressure fuel source, and wherein the apparatus further comprises a pressure relief conduit which leads from the pressure booster pressure chamber and communicates with the high-pressure fuel source via the metering valve device; this pressure relief conduit is closed by the pressure booster piston in the neutral state of the fuel injection apparatus and is only opened when a pressure drop occurs in the high-pressure fuel source.

2. The fuel injection apparatus according to claim 1, wherein the pressure booster piston is acted on by a compensation movement return spring device so that the pressure booster piston returns to its neutral position in the direction opposite from the pressure compensation movement.

3. The fuel injection apparatus according to claim 2, wherein the compensation movement return spring device is able to act on the pressure booster piston both in and counter to the direction of the pressure compensation movement.

4. The fuel injection apparatus according to claim 3, wherein the compensation movement return spring device is clamped between stop rings that are supported in opposite directions on an injector housing.

5. The fuel injection apparatus according to claim 4, wherein one of the stop rings rests against a collar on the pressure booster piston and delimits the pressure booster control chamber.

6. The fuel injection apparatus according to claim 5, wherein the stop ring that rests against the collar is able to move back and forth between two stops on the injector housing.

7. The fuel injection apparatus according to claim 6, wherein the metering valve device and/or the injection valve member and/or the pressure booster piston is/are integrated into the fuel injector.

8. The fuel injection apparatus according to claim 3, wherein the metering valve device and/or the injection valve member and/or the pressure booster piston is/are integrated into the fuel injector.

9. The fuel injection apparatus according to claim 4, wherein the metering valve device and/or the injection valve member and/or the pressure booster piston is/are integrated into the fuel injector.

10. The fuel injection apparatus according to claim 5, wherein the metering valve device and/or the injection valve member and/or the pressure booster piston is/are integrated into the fuel injector.

11. The fuel injection apparatus according to claim 2, wherein the compensation movement return spring device acts on the end of the pressure booster piston oriented away from the pressure booster pressure chamber and is situated in a pressure booster working chamber that communicates with the high-pressure fuel source.

12. The fuel injection apparatus according to claim 11, wherein the metering valve device and/or the injection valve member and/or the pressure booster piston is/are integrated into the fuel injector.

13. The fuel injection apparatus according to claim 2, wherein the compensation movement return spring device is clamped between a stop affixed to the injector housing and a collar, which collar is embodied on the pressure booster piston and delimits the pressure booster control chamber.

14. The fuel injection apparatus according to claim 13, wherein the metering valve device and/or the injection valve member and/or the pressure booster piston is/are integrated into the fuel injector.

15. The fuel injection apparatus according to claim 2, wherein the metering valve device and/or the injection valve member and/or the pressure booster piston is/are integrated into the fuel injector.

16. The fuel injection apparatus according to claim 1, wherein the metering valve device and/or the injection valve member and/or the pressure booster piston is/are integrated into the fuel injector.

* * * * *